United States Patent [19]

Usui

[11] Patent Number: 4,856,624

[45] Date of Patent: Aug. 15, 1989

[54] SLIDE TYPE EXHAUST BRAKE SYSTEM

[75] Inventor: Masayoshi Usui, Numazu, Japan

[73] Assignee: Usui Kokusai Sangyo Kaisha Ltd., Sunto, Japan

[21] Appl. No.: 276,207

[22] Filed: Nov. 23, 1988

[30] Foreign Application Priority Data

Nov. 25, 1987 [JP] Japan ..... 62-297167

[51] Int. Cl.[4] ..... F02D 9/06

[52] U.S. Cl. ..... 188/273; 137/338

[58] Field of Search ..... 137/338; 188/154, 273; 251/326

[56] References Cited

U.S. PATENT DOCUMENTS

| | | | |
|---|---|---|---|
| 742,308 | 10/1903 | Gerrard . | |
| 795,057 | 7/1905 | O'Brien . | |
| 1,436,412 | 11/1922 | Skiffington . | |
| 1,620,100 | 3/1927 | Hoxton . | |
| 2,845,306 | 7/1958 | Carver . | |
| 3,342,203 | 9/1967 | Abercrombie . | |
| 3,720,227 | 3/1973 | Curran . | |
| 4,062,332 | 12/1977 | Perr . | |
| 4,093,046 | 6/1978 | Perr | 188/273 |
| 4,205,704 | 6/1980 | Benson . | |
| 4,408,627 | 10/1983 | Harris | 137/242 |
| 4,452,269 | 6/1984 | Kindermann | 137/338 |
| 4,553,648 | 11/1985 | Suzuki et al. | 188/273 |
| 4,615,354 | 10/1986 | Bianchi | 137/110 |
| 4,671,489 | 6/1987 | Jankovic | 231/327 |
| 4,685,544 | 8/1987 | Takigawa et al. | 188/273 |
| 4,733,687 | 3/1988 | Takigawa et al. | 137/338 |
| 4,751,987 | 6/1988 | Takigawa et al. | 188/273 |

FOREIGN PATENT DOCUMENTS

| | | |
|---|---|---|
| 3009453 | 9/1981 | Fed. Rep. of Germany . |
| 2223602 | 10/1974 | France . |
| 55-117047 | 9/1980 | Japan . |
| 55-123328 | 9/1980 | Japan . |
| 55-123330 | 9/1980 | Japan . |
| 60-3437 | 9/1985 | Japan . |
| 14098 | 8/1891 | United Kingdom . |

*Primary Examiner*—Duane A. Reger

*Attorney, Agent, or Firm*—Anthony J. Casella; Gerald E. Hespos

[57] ABSTRACT

There is disclosed a slide type exhaust brake system including: a housing of an exhaust brake body having an exhaust passageway; an air cylinder unit leading to an upper end of a reciprocatory operation passageway; and a tabular valve member incorporated into the reciprocatory operation passageway and engaging with a tip of a piston rod penetrating a partition wall with respect to the air cylinder unit. The valve member has an exhaust pressure adjusting hole, undergoes a unidirectional thrust given by the piston rod tip when closing the exhaust passageway, and moves in the other direction together with the piston rod when opening the exhaust passageway. An improved brake system is further arranged such that: the valve member is composed of at least two valve components parallelly disposed and fitted to each other with pins; when closing the exhaust passageway, the valve member is moved in one direction by causing the one valve component to contact the opposite end surface of the other valve component; and when opening the exhaust passageway, the flowage spacing is formed between the contactual surfaces thereof, in which state the entire valve member is moved in the other direction with a linkage to the other valve component.

7 Claims, 3 Drawing Sheets

SLIDE TYPE EXHAUST BRAKE SYSTEM

BACKGROUND OF THE INVENTION:

1. Field of the Invention

The present invention is directed to an improvement of a valve mechanism in a slide type exhaust brake system, connected to the middle of an air release pipe, for imparting braking effects to a vehicle by blockading an exhaust passageway for an exhaust gas running through the air release pipe on the occasion of a sharp descent, typically in a large-sized vehicle such as a truck or a bus.

2. Description of the Prior Art

FIG. 7 illustrates a structure of a valve mechanism unit in this type of exhaust brake system. The valve mechanism consists of a tabular valve member (23) and an auxiliary valve member (27). The tabular valve member incorporated into a reciprocatory operation passageway of a housing of the body is formed as a single unit and includes an exhaust pressure adjusting hole (24) formed in a bottom wall surface thereof. The auxiliary valve member (27) is composed of a block member (25) fixed to a portion vicinal to the tip of a piston rod (26) and a liner unit (28) which is buffer-fitted to a bottom wall surface of a block member and slides on the surface of the valve member (23). When opening and closing the exhaust passageway, the tip of the piston rod (26) and a side wall surface of the block member (25) impinge upon and engage with the valve member (23) to provide up-and-down movements. Note that the numeral (29) represents an exhaust gas escape hole having a small diameter for preventing an excessive load on the machine body in a state where the exhaust passageway is closed.

The conventional valve mechanism is, however, attended with the following problems. Speaking of a structure of the auxiliary valve member (27), there exists a constraint to a size of the exhaust pressure adjusting hole (24) because of the slide surface of the valve member (23) in the limited space, and hence the exhaust pressure adjusting hole is not allowed to have a large diameter. As a result, a sufficient drop in exhaust pressure can not yet be attained. Besides, there is created abrasion or a "play" in the mutual impinging portion due to the engaging structure based on the impingement thereof when opening and closing the exhaust passageway. A life span of the product is reduced because of highly frequent repetition of opening/closing operations when being used, and hence the valve mechanism unit is short of durability.

SUMMARY OF THE INVENTION

It is a primary object of the present invention to provide a slide type exhaust brake system capable of, if necessary, simply forming a flowage spacing; exhibiting a smooth and rapid braking function by causing a sufficient and uniform drop in exhaust pressure in the flowage spacing; providing a long stretch of durability by remarkably alleviating abrasion associated with the impacts and reducing an amount of "play"; and also providing a favourable tightfitting to the seat surface on the side of a reciprocatory operation passageway by increasing a degree of freedom at the opening/closing operation by a valve member itself.

To this end, according to one aspect of the invention, in an exhaust brake system arranged such that: an exhaust brake body includes a housing reciprocatory operation passageway for a tabular valve member, the reciprocatory operation passageway being formed in the direction orthogonal to an exhaust passageway, out of which a connecting wall to an air release pipe protrudes at both ends thereof; the valve member incorporated into the reciprocatory operation passageway engages with the tip of the piston rod on the side of an air cylinder unit, the piston rod penetrating a partition wall with respect to the air cylinder unit leading to the upper end portion of the reciprocatory operation passageway; when closing the exhaust passageway by use of the valve member, the tip of the piston rod gives a unidirectional thrust against the valve member; and when opening the exhaust passageway, the valve member is moved in the other direction together with the piston rod, there is provided an improvement characterized in that: the valve member consists of at least two valve components buffer-fitted to each other with pins so that the valve components are parallelly disposed in the movable direction, permitting their mutual contact and separation; one of the components engages with the tip of the piston rod to constitute a movable structure integral with the piston rod; the unidirectional movement of the valve member as a whole is made by forcing one valve component to abut on the opposite end surface of the other valve component when closing the exhaust passageway; and when opening the exhaust passageway, the flowage spacing for adjusting the exhaust pressure is formed between the contactual surfaces of the two valve components just when one valve component separates therefrom, in which state the entire valve member is moved in the other direction with a linkage to the other valve component. Furthermore, the valve member may be composed of three or more pieces of separate valve components based on the linking structure.

The slide exhaust brake system according to the present invention adopts the linking structure in which the valve member includes the first and second separate valve components which are buffer-fitted to each other with the pins, and also the structure in which one valve component engages with the piston rod to permit the movement with the piston rod. Based on these structures, by virtue of the flowage spacing formed between the contactual surfaces of the valve components, it is possible to cause a sufficient and uniform drop in exhaust pressure even when there exists a constraint to the size of the valve member in the limited space, with the result that the braking functions smoothly and rapidly. The integrally movable structure and another structure, in which the valve components each having a sufficient contactual area are disposed vis-à-vis with each other, are combined to provide a considerable reduction both in abrasion and in play produced between the mutual contactual surfaces. The above-mentioned valve structure consisting of separate valve components contributes to an enhancement in degree of freedom at the opening/closing operations, thereby providing favourable tightfitting to the seat surface on the reciprocatory operation passageway.

Other and further objects, features and advantages of the invention will appear more fully from the following discussion taken in connection with the accompanying drawings.

DETAILED DESCRIPTION OF THE PREFERRED EMBODIMENTS

Figure 4:
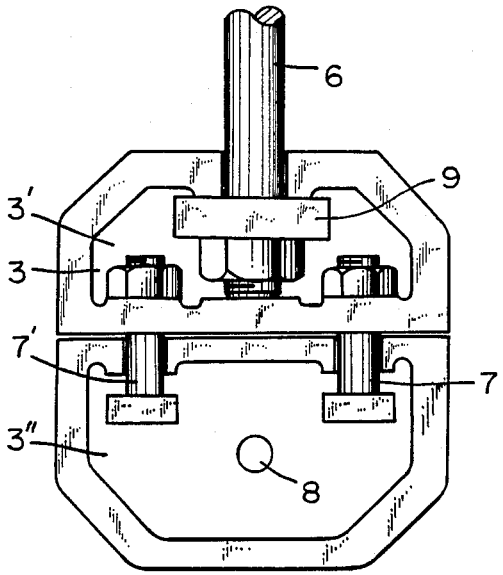
FIG. 4 is a view of assistance in explaining a state where the exhaust passageway depicted in FIG. 2 is closed.
Figure 5:
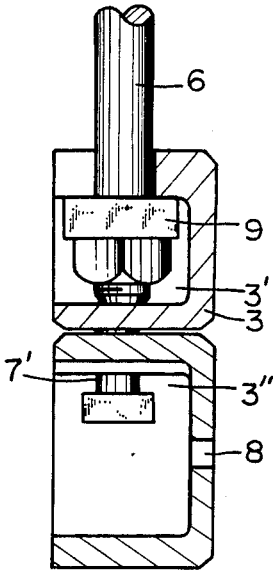
FIG. 5 is a fragmentary vertical sectional view of FIG. 4.
Figure 6:
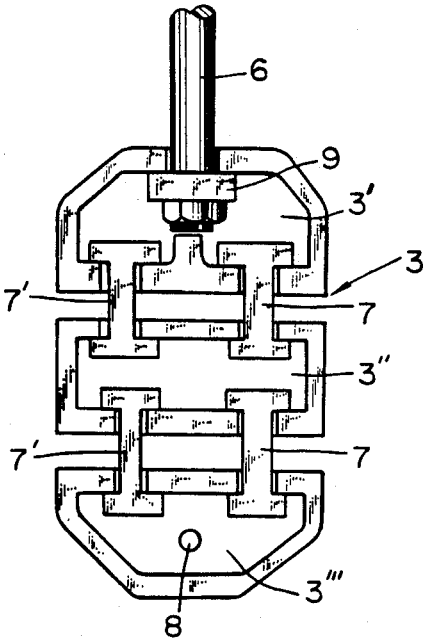
FIG. 6 is a plan view illustrating another embodiment of the present invention.
Figure 7:
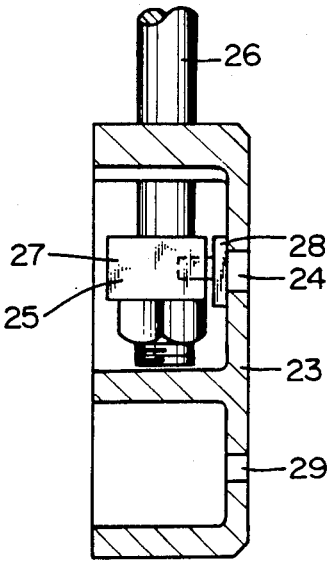
Fig. 7 PRIOR ART
FIG. 7 is a fragmentary vertical sectional view showing a conventional valve mechanism.

Referring first to FIGS. 1 through 6, the reference numeral (1) designates a housing of an exhaust brake body including a reciprocatory operation passageway for a tabular valve member (3), the reciprocatory operation passageway being formed in the direction orthogonal to an exhaust passageway (2), out of which a connecting wall (1') to an exhaust pipe protrudes at both ends thereof. The reciprocatory operation passageway accommodates the valve member (3) composed of first and second separate valve components (3') and (3'') which are parallelly disposed in the movable direction and buffer-fitted to each other with pins (7, 7'), permitting their contact and separation. A linking structure is thus obtained. A piston rod penetrates a partition wall with respect to an air cylinder unit (5) leading to the upper end portion of the reciprocatory operation passageway. The first valve component (3') engages, with almost no play, with the tip of the piston rod (6) on the side of the air cylinder unit (5), thus providing a movable structure integral with the piston rod. Note that each of the pins is formed with a large-diameter head at one end and is fitted with a nut at the other end. On the occasion of closing the exhaust passageway (2), the valve member (3) as a whole is moved downward with a thrust generated just when the first valve component (3') is brought into contact with the opposite end surface of the second valve component (3''). While on the other hand, when being closed, a flowage spacing (4) for adjusting an exhaust pressure is formed between the contactual surfaces of the first and second valve components (3') and (3'') immediately when the first valve component (3') separates therefrom. Then, an exhaust gas is instantaneously discharged from the flowage spacing, in which state the entire valve member (3) is moved upwards with a linkage to the second valve component (3''). The numeral (8) stands for an exhaust gas escape hole, formed in a bottom wall of the second valve component (3'') to have a small diameter, for preventing an excessive load on the machine body when closing the exhaust passageway. The numeral (9) denotes a block member interposed in and fixed to an engaging portion of the first valve component (3'). The valve member (3) is, as illustrated in FIG. 6, constituted by three pieces of separate valve components (3', 3'', 3'''), which may be buffer fitted or linked to each other in the above-described manner. Alternatively, the valve member may be formed of a still larger number of valve components. Sleeves may be attached to outer peripheries of the pins (7, 7') with a view to preventing the abrasion.

Figure 1:
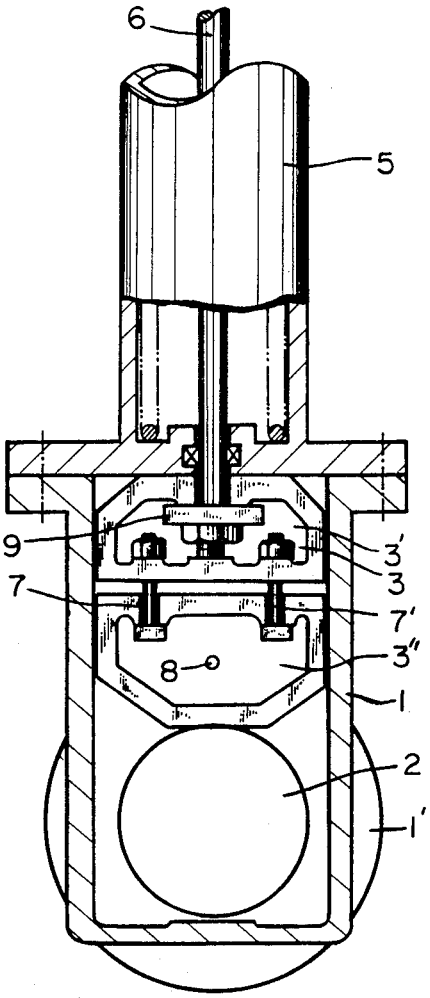
FIG. 1 is a partially cut-away plan view of a slide type exhaust brake system, showing one embodiment of the present invention.
Figure 2:
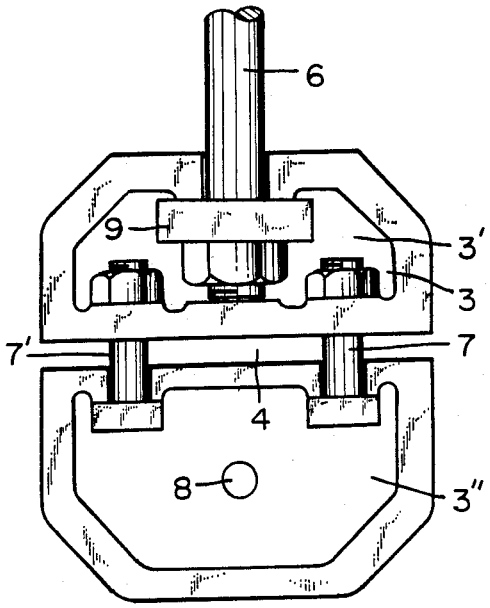
FIG. 2 is an enlarged view illustrating the principal portion depicted in FIG. 1 according to the present invention when opening an exhaust passageway by use of a valve member.
Figure 3:
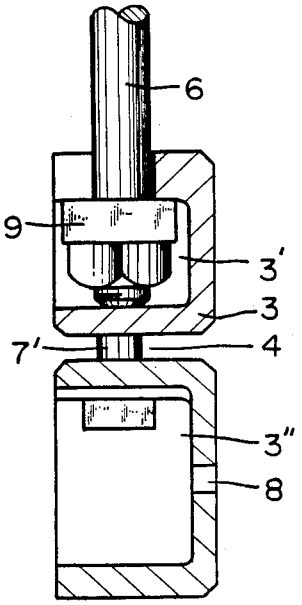
FIG. 3 is a fragmentary vertical sectional view of FIG. 2.

In accordance with the present invention having such a constitution, in the case of closing the exhaust passageway by use of the valve member (3), as illustrated in FIGS. 4 and 5, the first valve component (3') comes into contact with the second valve component (3'') with a movement of the piston rod (6). As a result, the valve member (3) as a whole is moved downwards, thereby closing the exhaust passageway. When opening the exhaust passageway, as depicted in FIGS. 2 and 3, there is instantaneously discharged the exhaust gas stagnant in the flowage spacing, formed between the contactual surfaces of the first and second valve components (3') and (3'') just when the first valve component (3') separates from the second valve component (3''), for adjusting the exhaust pressure. In this state, the entire valve member (3) is moved upwards with the linkage to the second valve component (3'') by employing the pins (7, 7'), and the exhaust passageway is thereby opened. Even when the valve member is accommodated in the limited space, a linkage length of the buffer-fitting portion by use of the pins (7, 7') can be set according to the demands. In consequence, the flowage spacing (4) can readily sufficiently be formed, and it follows that the exhaust passageway is opened and closed with the linkage to the first valve component (3') engaging with the tip of the piston rod (6) so as to be movable together.

As many apparently widely different embodiments of this invention may be made without departing from the spirit and scope thereof, it is to be understood that the invention is not limited to the specific embodiments thereof except as defined in the appended claims.

What is claimed is:

1. A slide type exhaust brake system comprising:

a housing having an exhaust passageway with opposed ends connectable respectively to exhaust pipes and a reciprocatory operation passageway communicating with the exhaust passageway and angularly aligned thereto;

a cylinder unit mounted in proximity to said housing, said cylinder unit comprising a cylinder and a piston rod reciprocally movable into and out of the cylinder, said piston rod having an end disposed in the operation passageway and movable reciprocally toward and away from the exhaust passageway; and a tabular valve member slidably movable between said reciprocatory operation passageway and said exhaust passageway and being dimensioned for substantially blocking said exhaust passageway, said tabular valve member comprising a first valve component rigidly mounted to the piston rod adjacent the end thereof and movable with said piston rod as an integral structure, said tabular valve member further comprising a second valve component buffer-fitted to said first valve component on a side thereof generally opposite said piston rod, the buffer-fitting permitting limited relative movement between said first and second valve components, such that in a first relative position said first and second valve components are in abutting contact with one another, and such that in a second relative position said first and second valve components are in limited spaced relationship to one another to define a flowage spacing therebetween, whereby the movement of said piston rod from said cylinder urges said first valve component into said second valve component and urges said first and second valve components into said exhaust passageway, and whereby the movement of said piston rod into said cylinder initially urges said first valve component away from said second valve component to define the flowage spacing therebetween, and subsequently urges said first and second valve components into said reciprocatory operation passageway to open said exhaust passageway.

2. A brake system as in claim 1 wherein said first and second valve components are buffer fitted to one another in generally end-to-end relationship.

3. A brake system as set forth in claim 1 further comprising at least a third valve component buffer fitted to said second valve component of said tabular valve member for limited relative movement therebetween.

4. A brake system as set forth in claim 1 further comprising at least one pin mounted to and extending between said first and second valve components for permitting limited relative movement therebetween.

5. A brake system as set forth in claim 4 comprising a plurality of said pins disposed in generally parallel relationship to one another.

6. A brake system as set forth in claim 4, wherein each of said pins is formed with a large-diameter head at one end engageable with one of said valve components and fitted with a nut at the other end engageable with the other of said valve components.

7. A brake system as set forth in claim 1, wherein said valve member includes an exhaust pressure adjusting hole extending therethrough.

* * * * *